US006460366B1

(12) United States Patent
Kim

(10) Patent No.: US 6,460,366 B1
(45) Date of Patent: Oct. 8, 2002

(54) REINFORCED STRUCTURE OF FRONT LOWER PANEL FOR A PACKAGE AIR CONDITIONER AND METHOD OF MAKING THE SAME

(75) Inventor: Jung-suk Kim, Gyunggi-do (KR)

(73) Assignee: Mando Climate Control Corporation, Chungcheongnam-do (KR)

( * ) Notice: Subject to any disclaimer, the term of this patent is extended or adjusted under 35 U.S.C. 154(b) by 0 days.

(21) Appl. No.: 09/924,311

(22) Filed: Aug. 7, 2001

(30) Foreign Application Priority Data

Sep. 1, 2000 (KR) ..... 00-51656

(51) Int. Cl.[7] ..... F25D 19/00; F24F 7/007
(52) U.S. Cl. ..... 62/298; 454/234; 312/236
(58) Field of Search ..... 62/298, 410, 412, 62/89; 312/236; 454/234, 261, 275

(56) References Cited

U.S. PATENT DOCUMENTS 5,735,137 A 4/1998 Kim
5,787,717 A 8/1998 Bang
6,059,654 A 5/2000 Kim

FOREIGN PATENT DOCUMENTS

JP 405010547 A * 1/1993

* cited by examiner

*Primary Examiner*—Chen-Wen Jiang
(74) *Attorney, Agent, or Firm*—John P. White; Cooper & Dunham LLP

(57) ABSTRACT

A reinforced structure of the front lower panel for a package air conditioner may comprise a front lower panel, which is mounted on the front lower portion of the indoor unit of the air conditioner having a blower device for air circulation, evaporator coils for heat exchange, permitting the air inside the interior space to flow into the indoor unit for passing across the evaporator coils through the air inlets 12 and 12', and includes the reinforcement structures formed on the inner corner portion between a front frame 11*a* and a side portion of the frame 11*c* having air guides 20 of the front lower panel 11, to strengthen the structural rigidity of the frames.

3 Claims, 4 Drawing Sheets

REINFORCED STRUCTURE OF FRONT LOWER PANEL FOR A PACKAGE AIR CONDITIONER AND METHOD OF MAKING THE SAME

BACKGROUND OF THE INVENTION (1) Field of the Invention

The present invention relates to a front lower panel of an indoor unit for a package air conditioner, and more specifically to a reinforced structure of front lower panel for a package air conditioner having enhanced structural endurance and improvement in the appearance with the rib structure, which is molded by gas-assisted injection molding for reinforcing an air inlet portion, and the method of making the same.

(2) Description of the Prior Art

Generally, in the gas-assisted injection molding process, pressurized inert gases (nitrogen) introduce into the melt stream of a part. This special injection molding method is becoming more popular in the injection molding industry due to more complex parts.

In general, the air conditioner properly maintains the temperature of indoor spaces such as the office, living room, or the inside of building, for activity by supplying the cool air into the airtight indoor spaces, having the air conditioning as the basic function.

This air conditioner is consisted of the an indoor and outdoor unit, the case of being composed of one body is called one body type air conditioner, and the case of being composed separately is called a separate type air conditioner. The representative example of that is the window type air conditioner, and the ones of this are the tapestry type air conditioner and the package type air conditioner. This invention explains the package air conditioner used much recently among the air conditioners classified as above.

The package air conditioner is consisted of the indoor unit and the outdoor unit, and the heat exchanger (evaporator) is installed in that as the indoor unit, the indoor air imbibed by the blower is cooled by passing through this heat exchanger and is discharged again into the indoor space making the indoor air conditioning. In this outdoor unit, compressor and condenser are installed, the compressor plays the role of compressing the refrigerant flown from the heat exchanger of indoor unit, and the condenser plays the role of condensing the refrigerant flown from the compressor through the heat exchange with the environmental air imbibed by a fan and plays the role of sending this to the heat exchanger of the indoor unit.

FIG. 1 shows the indoor unit 1 of the package air conditioner by the prior art.

With reference to the FIG. 1, the heat exchanger is installed in the indoor unit 1, so with the process of refrigerant flown from the condenser of the outdoor unit (not shown) passing through the heat exchanger, the indoor air imbibed by the blower is cooled frosty in the process of passing through the heat exchanger, and is supplied indoors to make air cooling.

The refrigerant heat-exchanged with the indoor air passing through the heat exchanger is supplied to the compressor of the outdoor unit again, compressed, and then supplied to the condenser of the outdoor unit.

On the front lower panel 1*a* placed on the front lower portion of the indoor unit 1, a plurality of air inlet ports 2 to imbibe the indoor air is provided, and the upper portion of the indoor unit 1 is provided with an outlet vent 3 to discharge the cooled air through the indoor heat exchanger indoors again. On the outlet vent 3 of the indoor unit 1, a plurality of blades 5 is installed to change the wind direction of the air discharged indoors. In general, these blades 5 have a structure possible of alternating motion vertically and side ways change the wind direction. Approximately on the middle part of the indoor unit, the control panel 4 is provided to control the entire operating condition or to set up the air-cooling temperature.

In case of the indoor unit 1 of the conventional package air conditioner with this structure, a plurality of air inlet ports 2 is provided on the front side of the front lower panel to imbibe the indoor air, so the external appearance becomes unattractive.

Besides, the indoor unit described above has a weak structure because of the plurality of the air inlets inhaling the air on the front lower panel 1*a*. Therefore, the front lower panel may be fractured by a user who disassembles it repeatedly for cleaning the interior of the indoor unit and the air filter.

In addition, the front lower panel has considerable problems for making the reinforced structure by gas-assisted injection molding, because the inside of the front lower panel has complicated interior shape and sophisticated frame elements, e.g., a plurality of projection portion and a mount portion for fixing the air filter or air purifiers, etc.

SUMMARY OF THE INVENTION

It is an object of this invention to provide a reinforced structure of front lower panel for a package air conditioner provided with the reinforcement means to strengthen the frames of the front lower panel having the air inlets on both sides and the front side.

It is another object of this invention to provide a method of making a reinforced structure of front lower panel for a package air conditioner by the gas-assisted injection molding process capable of achieving the reinforced frame of the front lower panel.

In accordance with this present invention a reinforced structure of front lower panel for a package air conditioner comprising of: a blower device for air circulation; evaporator coils for heat exchange; and the front lower panel, which is placed on the front and lower portion of a indoor unit, having air inlets on the front lower portion and both sides, permitting the air inside the interior space to flow into the indoor unit for passing across the evaporator coils through the air inlets, and including the reinforce means formed on the inner corner portion between a front frame and a side portion of the frame having air guides of mentioned front lower panel, to strengthen the structural rigidity of the frames.

Further, in accordance with this present invention a method for making the reinforced structure of the front lower panel for the package air conditioner comprising of: forming the outward form of the front lower panel consisting of air guides by an injection mold; installing gas channels on the inner corner portion between the front frame 11*a* and the side portion 11*c* of the frame 11*a* of said front lower panel, and the air guides; injecting resins with a pressurized inert gas into the empty mold cavity of the gas channels; and forming the reinforcement means having a hollow on the mentioned front lower panel as one body.

BRIEF DESCRIPTION OF DRAWINGS

Other objects and aspects of the present invention will become apparent from the following description of embodiments with reference to the accompanying drawing in which.

DESCRIPTION OF THE PREFERRED EMBODIMENTS

Figure 2:
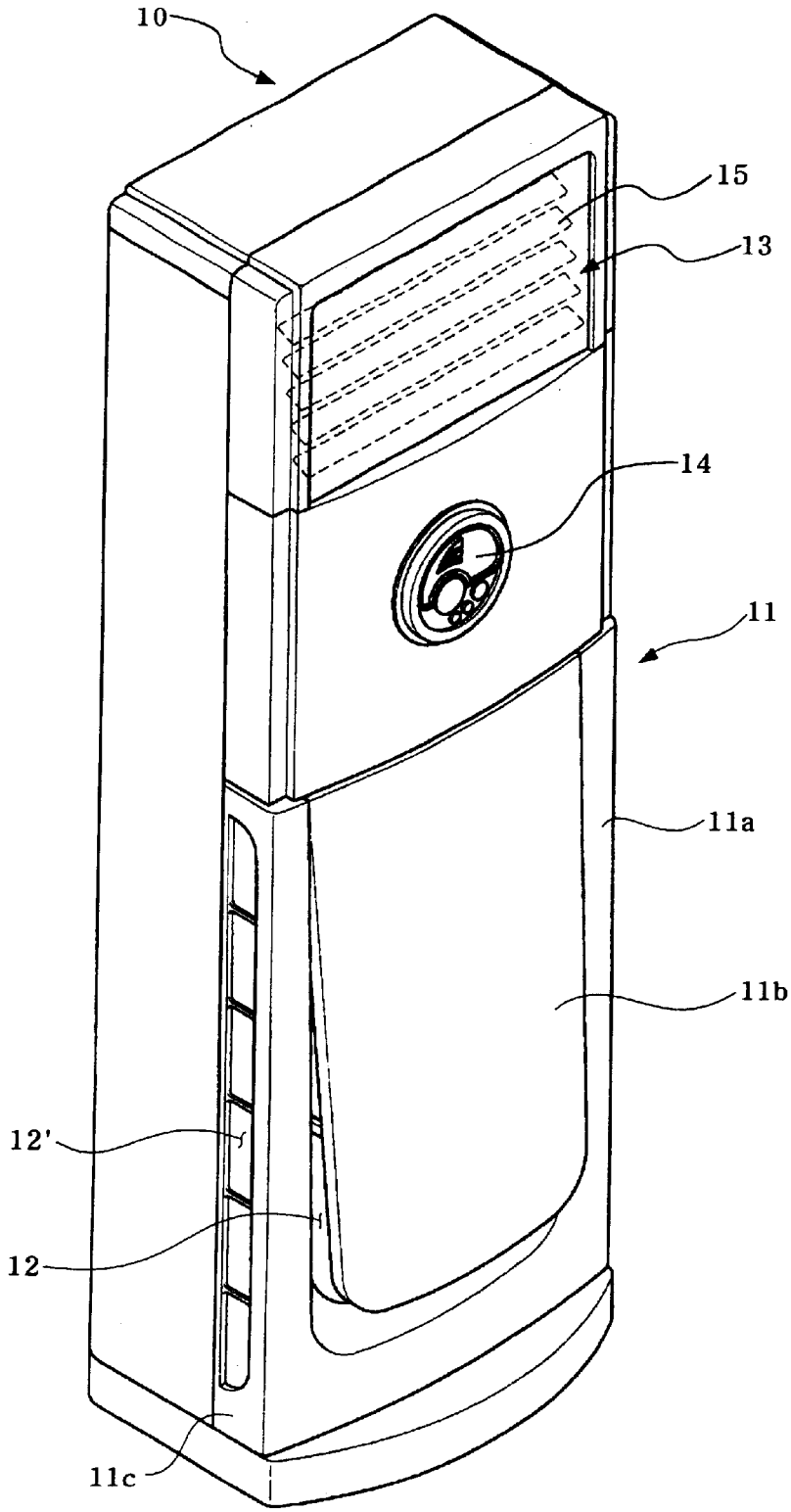
FIG. 2 is a perspective front view showing the construction of a indoor unit of a preferred embodiment in accordance with the present invention.

FIG. 2 shows an indoor unit of an air conditioner in accordance with the present invention.

An indoor unit 10 according to the present invention is provided with a front lower panel 11, a control panel 14 and an automatic covering outlet panel 13 mounted on the front of the unit body.

Figure 4:
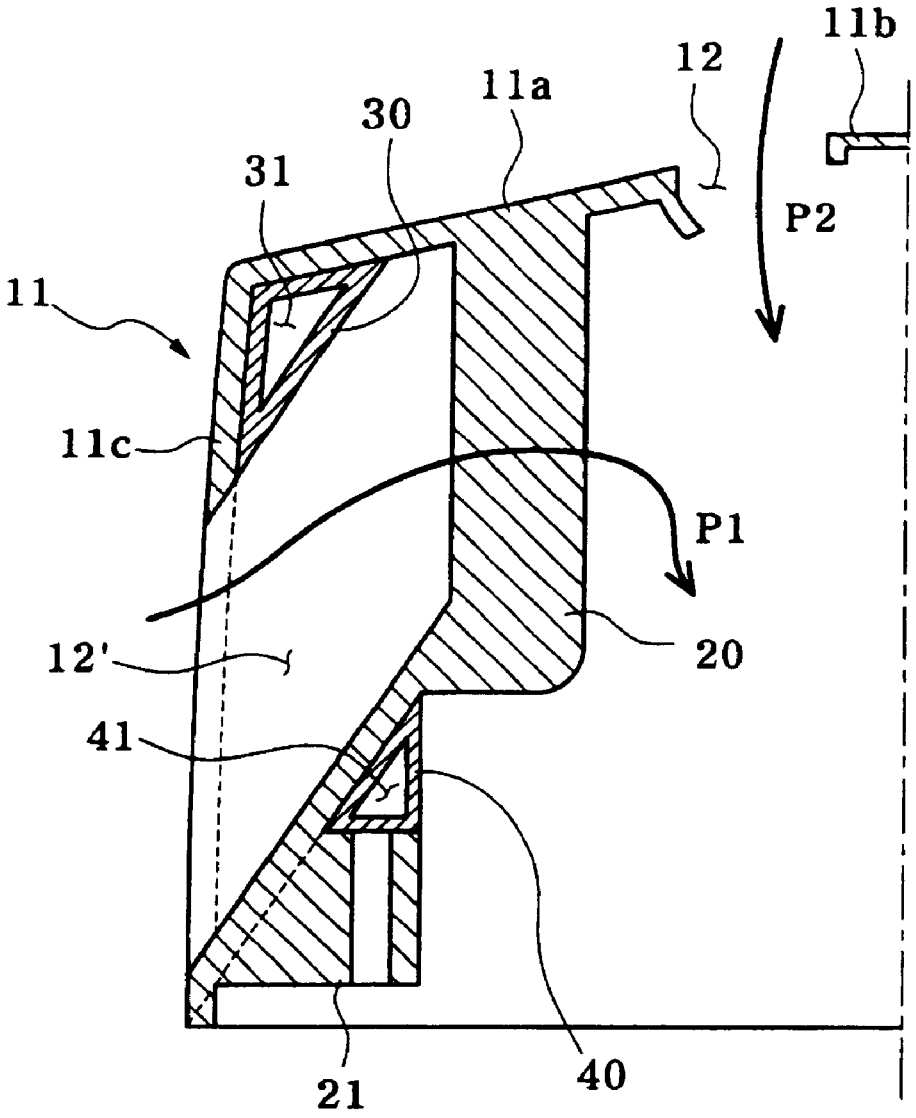
FIG. 4 is a cross sectional view along the line A—A in FIG. 3, partially omitted, showing the reinforced structure of the front lower panel.

The front lower panel 11, which consists of a front frame 11*a*, a plate 11*b* and a side portion 11*c* of the frame 11*a* having both sides and the bottom side, has air inlet ports 12 and 12' on the front and both sides of panel body for the air flow P1 and P2 (shown in FIG. 4). The outlet panel 13 has a plurality of blades 15 installed possible to move vertically and horizontally to modulate the wind direction though not shown in detail.

Figure 1:
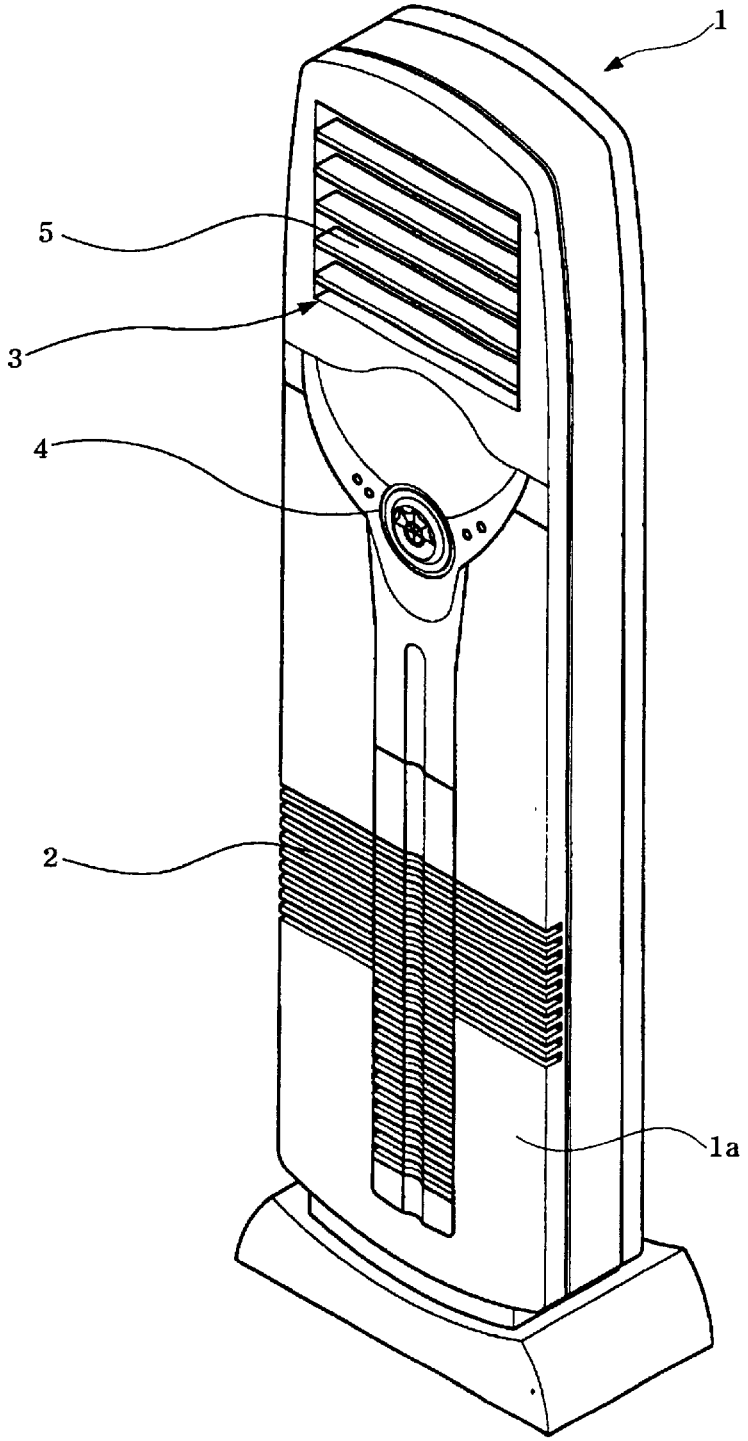
FIG.1 (PRIOR ART)
FIG. 1 is a perspective front view showing the prior art indoor unit of the package air conditioner.

The plate 11*b* of the front lower panel 11 is inclined based on the center of upper portion, so that the bottom portion of the plate 11*b* is relatively protruded to provide the first air inlet port 12. This is the unique design that the plate 11*b* has a shield shaped outlook. In accordance with the present invention, there is an advantage in that the front lower panel 11 of the preferred embodiment relatively more fascinated than the prior art front lower panel (1*a* of FIG. 1), and results an increasing of the relative endurance on all frames.

Further, the first air inlet port 12 has the gap between three sides of the plate 11*b*, i.e., one lower side and two sides, and the inner sides of the front frame 11*a*, so that the air inside the interior space could be effectively communicated to the evaporator coils (not shown) in the indoor unit 10 through the first air inlet port 12 making the air flow evenly.

In other words, the indoor unit 10 of the present invention makes the air inside interior space being communicated through the first air inlet port 12 having three sides of the gap, in comparison to the structure, while the air inside the interior space is communicated through the front side of the front lower panel of the prior art indoor unit. This induces the unified air flown and decentralized supply of the air.

Accordingly, the indoor unit 10 could have higher thermal agitation efficiency than the prior art indoor unit, and entirely improved cooling performance.

The side portion 11*c* of the frame 11*a* of the front lower panel 11, however, has structural weak endurance and concerns on modification or breakage because of a smaller width in comparison to the width of the front frame 11*a*, and being provided with a plurality of the second air inlet ports 12'.

Figure 3:
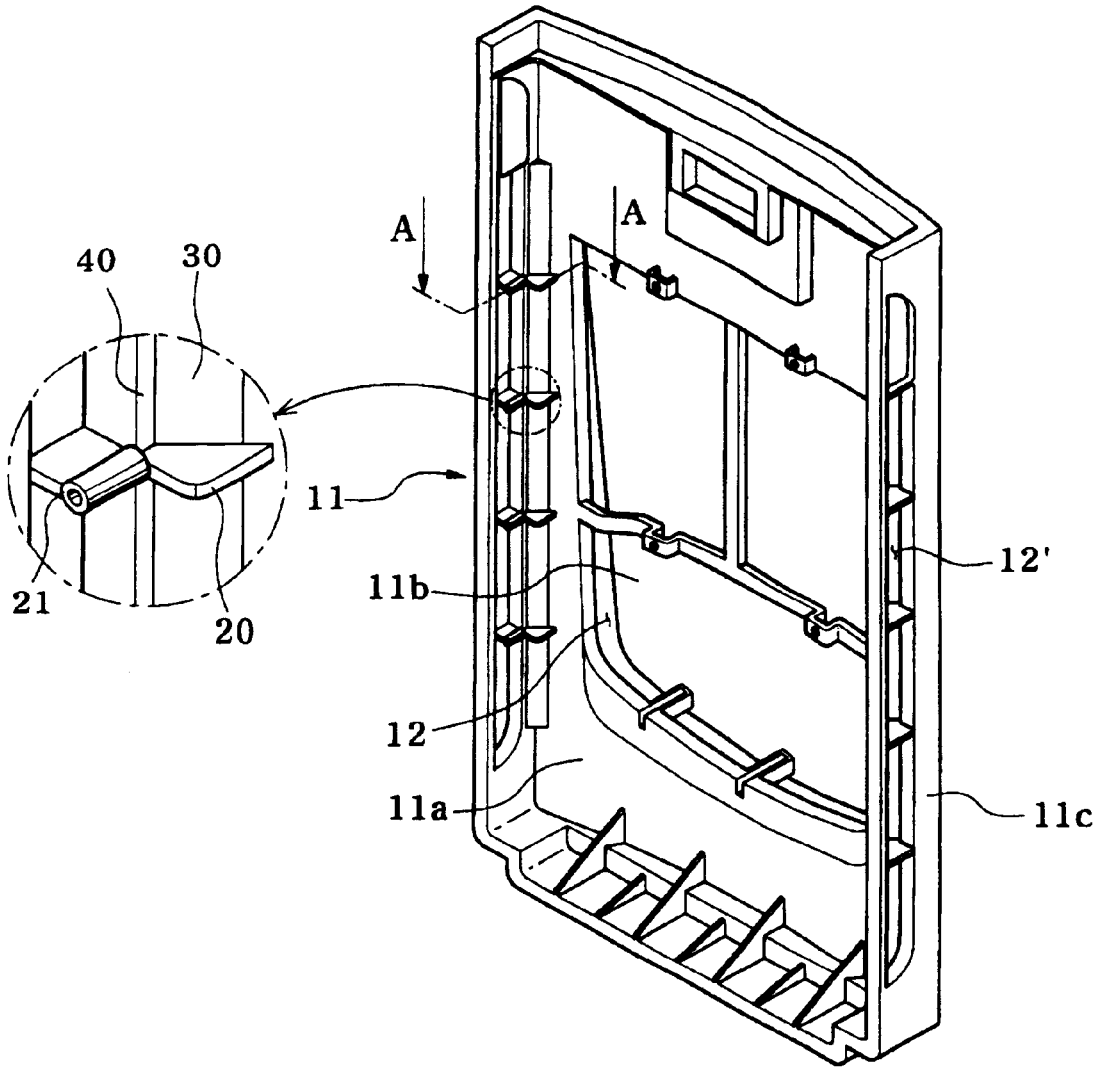
FIG. 3 is a perspective rear view showing the front lower panel of the indoor unit shown in FIG. 2.

As shown in FIG. 3 and FIG. 4, the first reinforcement rib 30 shaped of a triangular and hollow prism, which is provided on the inner corner portion between the front frame 11*a* and the side portion 11*c* of the frame 11*a* as one body, stands vertical to a plurality of air guides 20. In other words, the first reinforce rib 30 is extended with the longitudinal direction of the front lower panel 11.

Herein, it is obvious that the first reinforce rib 30, which is formed between the front frame 11*a* and the side portion 11*c* of the frame 11*a*, defines as the reinforcement is meant to support the bending forth in the bending portion as well as to strengthen structural rigidity of the frame 11*a*.

Besides, the second reinforce rib 40, which has the similar shape of the first reinforce rib 30, is longitudinally provided on the air guides 20.

Herein, the air guides 20 are provided on the inner portion of the second air inlet ports 12' and arranged at regular intervals. Further, the air guides 20 has the mount portion 21, which is provided with a bolt hole for fixing the mount frame of an air purifier and its supporter, for example, an air filter, a bundle of its electric wires, etc., at the lateral surface. Moreover, the upper portion of each air guides 20 is extended from the portion closed on the edge of the side portion 11*c* of the frame 11*a* to the other portion closed on the edge of the side portion 11*c* thereof with the same direction of the second air inlet ports 12' which is inclined to the front frame 11*a*. Furthermore, the bottom portion of each air guides 20 stands vertical to the inner surface of the front frame 11*a*.

Accordingly, all of the air guides 20 are supported laterally by the front frame 11*a* and the side portion 11*c* of the frame 11*a*, and are reinforced longitudinally by the second reinforcement rib 40.

It is also obvious that the second reinforcement rib 40 defines as to strengthen structural rigidity of the all of air guides 20.

Besides, the first and the second reinforce rib 30 and 40 has the hollow 31, 41 (shown in FIG. 4), which are made by the gas-assisted injection molding process and used by gas channels.

The following will explain the method for making the reinforced structure of the front lower panel for the package air conditioner by the gas-assisted injection molding process.

It is the initial phase that the outward form of the front lower panel 11 having the air guides 20 is formed by an injection mold (not shown) in the injection molding process.

In phase two, the gas channels, which are extended with the longitudinal direction of the front lower panel 11, are installed on the inner corner portion between the front frame 11*a* and the side portion 11*c* of the frame 11*a*.

In phase three, resins with the pressurized inert gas is injected into the empty mold cavity of the gas channels, for example, nitrogen gas in kind of general gas-assisted injection mold process.

Finally, the first reinforcement rib 30 having the hollow 31 is formed on the front lower panel 11 as one body.

The second reinforcement rib 40 is also formed below the portion of the mount portion 21 of the air guides 20 in the same manner as the above method for making the reinforcement rib 30.

As a result, the reinforced structure of the front lower panel for the package air conditioner in accordance with the present invention, could be capable of maintaining the structural stability and improving the reliability of products by the first and the second reinforcement rib, even if the exterior impact inflicts the panel body repeatedly, as the front lower panel, which is reinforced.

Further, the method for making the reinforced structure of the front lower panel for the package air conditioner, by using the gas-assisted injection molding process, is easy to make the front lower panel with the first and the second reinforcement rib close to the first and the second air inlet. Therefore, the invention in its broader aspect is not limited to the specific details and representative embodiments shown and described herein. Accordingly, various modifications may be made without departing from the spirit of scope of the general inventive concept as defined by the appended claims and their equivalents.

What has been claimed:

1. A reinforced structure of front lower panel for a package air conditioner comprises of: a blower device for air circulation; evaporator coils for heat exchange; and the front lower panel, which is placed on the front and lower portion of a indoor unit, having air inlets on the front lower portion and both sides, permitting the air inside the interior space to flow into the indoor unit for passing across the evaporator coils through the air inlets, and including the reinforcement means formed on the inner corner portion between a front frame and a side portion of the frame having air guides of front lower panel, to strengthen the structural rigidity of the mentioned frames.

2. The reinforced structure of claim 1, wherein said reinforce means are at least two of the reinforcement ribs provided on said front lower panel with longitudinal extended direction of the panel body.

3. A method for making the reinforced structure of the front lower panel for the package air conditioner comprising of: forming the outward form of the front lower panel having air guides by an injection mold; installing gas channels on the inner corner portion between the front frame 11*a* and the side portion 11*c* of the frame 11*a* of the front lower panel, and the air guides; injecting resins with a pressurized inert gas into the empty mold cavity of the gas channels; and forming the reinforcement means having a hollow on front lower panel as one body.

* * * * *